US012138517B2

(12) United States Patent
Schwartz

(10) Patent No.: US 12,138,517 B2
(45) Date of Patent: Nov. 12, 2024

(54) SYSTEMS AND METHODS FOR TRAINING THE EXECUTION OF A SAFE SLIDE

(71) Applicant: Adam Joshua Schwartz, Scottsdale, AZ (US)

(72) Inventor: Adam Joshua Schwartz, Scottsdale, AZ (US)

(73) Assignee: SAFESLIDE PRO LLC, Scottsdale, AZ (US)

( * ) Notice: Subject to any disclaimer, the term of this patent is extended or adjusted under 35 U.S.C. 154(b) by 135 days.

(21) Appl. No.: 17/571,240

(22) Filed: Jan. 7, 2022

(65) Prior Publication Data

US 2022/0323840 A1 Oct. 13, 2022

Related U.S. Application Data

(60) Provisional application No. 63/257,252, filed on Oct. 19, 2021, provisional application No. 63/172,256, filed on Apr. 8, 2021.

(51) Int. Cl.
*A63B 69/00* (2006.01)
*A63B 102/18* (2015.01)

(52) U.S. Cl.
CPC ..... *A63B 69/00* (2013.01); *A63B 2102/18* (2015.10); *A63B 2102/182* (2015.10); *A63B 2210/50* (2013.01); *A63B 2225/093* (2013.01); *A63B 2243/0025* (2013.01); *A63B 2243/007* (2013.01)

(58) Field of Classification Search
CPC ..... A63B 69/00
USPC ..... 473/422, 443–445
See application file for complete search history.

(56) References Cited

U.S. PATENT DOCUMENTS

| | | | | | |
|---|---|---|---|---|---|
| 4,921,245 | A * | 5/1990 | Roberts | A63B 7/02 | 482/42 |
| 5,024,601 | A * | 6/1991 | Barker | A63C 3/00 | 482/68 |
| 5,334,121 | A * | 8/1994 | McPhilomy | A63K 3/043 | 482/17 |
| 5,813,925 | A * | 9/1998 | Lewy | A63B 69/0079 | 473/430 |
| 6,162,148 | A * | 12/2000 | Lockwood | A63B 69/00 | 482/16 |
| 8,075,425 | B2 * | 12/2011 | Conwright | A63B 69/0071 | 473/422 |
| 8,795,023 | B2 | 8/2014 | Elson | | |
| 9,675,829 | B1 * | 6/2017 | Katz | A63B 17/02 | |
| 10,220,252 | B2 * | 3/2019 | Jackson | A63B 21/4035 | |
| 10,315,086 | B1 | 6/2019 | Johnson | | |
| 2006/0160681 | A1 * | 7/2006 | McBride | A63B 1/00 | 482/129 |

(Continued)

FOREIGN PATENT DOCUMENTS

DE 26 14 994 A1 10/1977

*Primary Examiner* — Mitra Aryanpour
(74) *Attorney, Agent, or Firm* — BOOTH UDALL FULLER, PLC; Pacer K. Udall

(57) ABSTRACT

A slide training apparatus is provided including a slide support structure. The slide support structure includes side supporting elements and a cross bar supported by the side supporting elements and having an adjustable height. The side supporting elements may be attached at lower ends to feet, wheels, or base support elements. The apparatus may further include a mat disposed at least partially under the slide support structure.

4 Claims, 6 Drawing Sheets

(56) References Cited

U.S. PATENT DOCUMENTS

2017/0120099 A1* 5/2017 Biddix, Jr. ..... A63B 23/1218
2022/0323840 A1* 10/2022 Schwartz ..... A63B 17/04

* cited by examiner

SYSTEMS AND METHODS FOR TRAINING THE EXECUTION OF A SAFE SLIDE

CROSS-REFERENCE TO RELATED APPLICATIONS

This application claims the benefit of U.S. Provisional Application 63/172,256, filed Apr. 8, 2021 and U.S. Provisional Application 63/257,252, filed Oct. 19, 2021, the disclosures of which are incorporated herein by reference in their entireties.

BACKGROUND

1. Field

Apparatuses and methods consistent with example embodiments relate to sports training devices, and in particular to training devices for sliding.

2. Description of the Related Art

Sliding is an integral part of many sports including, among others, baseball, softball, soccer, football. A 2017 study of professional baseball players published in the American Journal of Sports Medicine found that over the span of five seasons, 1633 sliding injuries occurred resulting in 4263 days missed. Over 12 percent of sliding injuries sustained by Major League players during the study period required surgery (8.2% overall).

Understandably, a foot-first sliding technique is safer than a head-first sliding technique (1 in 413 slides versus 1 in 233 slides, respectively), because it better protects the player's head and upper extremities. Improper sliding techniques contribute heavily to the burden of injuries. Over 50% of surgical cases attributable to sliding are likely due to upper extremity injuries, predominantly those of the hand and shoulder. Potentially worsening this problem is that many current Major League Baseball players believe that instant replay discourages a foot-first technique, as it can lead to the foot coming slightly off the bag while the tag is applied, which is an avoidable problem with proper technique. Unsafe sliding practices may become even more prevalent as professionals increase the frequency of head-first slides, and younger players and their coaches try to emulate these unsafe practices. Injuries to the upper extremities are completely avoidable with a proper foot-first technique.

The skill of sliding is frequently overlooked by coaches and parents because of a lack of standardized technique and effective tools for teaching to teach this. Players who are injured the first time attempting a slide may develop a fear of sliding, and may never try again, or even worse, may only try again during a game situation without the skills necessary to execute a slide correctly. This can place the player at a high risk for injury.

One training tool currently available to teach sliding technique is essentially a soft pad that slides on top of a larger bottom mat. The device neither encourages a foot-first technique, nor does it teach a player how to keep their hands off the ground and high in the air which can significantly reduce the incidence of hand injuries. Additionally, the device does not teach a player how to slide on dirt, which can be a challenging and stressful transition for a player just learning how to slide.

Clearly, an improved training tool is needed with one or more of the following features: portability; ease of use alone (without the need for a coach or other assistance); ability to teach proper body, upper extremities; and leg positions; applicability to multiple ground surfaces; ability to encourage a foot-first technique; and ability to encourage keeping a player's hands off the ground.

SUMMARY

Example embodiments may address at least the above problems and/or disadvantages and other disadvantages not described above, and may provide the above-described features.

Also, example embodiments are not required to overcome the disadvantages or provide the features as described above.

One or more example embodiments may provide a training device enabled to teach a proper sliding technique. One or more example embodiments may incorporate an overhead support that a player can grab as they approach, in order to hold themselves off the ground and learn to position their legs appropriately for a slide.

According to an aspect of an example embodiment, a slide training apparatus is provided comprising: a slide support structure comprising: a first side beam and a second side beam; a first pair of support legs, each connected at an upper end thereof to the first side beam, and configured to hold the first side beam such that it extends in a first direction; a second pair of support legs, each connected an upper end thereof to the second side beam, and configured to hold the second side beam such that it extends in the first direction; a cross bar; a first plurality of brackets attached to the first side beam; a second plurality of brackets attached to the second side beam; wherein each of the first plurality of brackets is configured to support a first end of the cross bar, and each of the second plurality of brackets is configured to support a second end of the cross bar, such that when positioned with the first end in one of the first plurality of brackets and the second end in one of the second plurality of brackets, the cross bar extends in a second direction, substantially perpendicular to the first direction.

The slide training apparatus may further comprise a mat positioned at least partially between the first side beam and the second side beam and at least partially underneath the cross bar.

According to an aspect of another example embodiment, a slide training apparatus is provided including: a slide support structure comprising: a first foot and a second foot; an arch comprising a first end supported on the first foot and a second end supported on the second foot; a first handle and a second handle attached to the arch.

The slide training apparatus may further comprise: a first extension element attached between the first handle and the arch; and a second extension element attached between the second handle and the arch.

According to an aspect of another example embodiment, a slide training apparatus includes: a slide support structure comprising: a first base support and a second base support, each extending in a first direction a first side post attached to and extending from the first base support in a second direction, substantially perpendicular to the first direction; a second side post attached to and extending from the second base support in the second direction; a cross bar comprising a first end attached to the first side post and a second end attached to the second side post, such that the cross bar extends in a third direction, substantially perpendicular to both the first direction and the second direction.

The first side post may comprise a first lower unit removably attached to the first base support and a first upper unit removeably attached to the first lower unit; the second side post may comprise a second unit removably attached to the second base support and a second upper unit removeably attached to the second lower unit; and the cross bar may comprise a first corner joint removably attached to the first upper unit and a second corner joint removably attached to the second upper unit.

A first sleeve and a second sleeve may each be disposed circumferentially around the cross bar and rotatable therearound.

The slide training apparatus may further comprise: a first pair of wheels, wherein one of the first pair of wheels is attached to each end of the first base support; and a second pair of wheels, wherein one of the second pair of wheels is attached to each end of the second base support.

The first side post may comprises a first lower side element removably attached to the first base support and a first upper side element removably attached to the first lower side element; the second side post may comprise a second lower side element removably attached to the second base support and a second upper side element removably attached to the second lower side element; the cross bar may comprise a first end removably attached to the first upper side element and a second end removably attached to the second upper side element; the first base support may comprise a pair of first base elements and a first base connect element, wherein the first base connect element is removably attached between the pair of first base elements and removably attached to the first lower side element; and the second base support may comprise a pair of second base elements and a second base connect element, wherein the second base connect element is removably attached between the pair of second base elements and removably attached to the second lower side element.

BRIEF DESCRIPTION OF THE DRAWINGS

The above and/or other aspects will become apparent and more readily appreciated from the following description of example embodiments, taken in conjunction with the accompanying drawings in which.

DETAILED DESCRIPTION

Figure 1A:
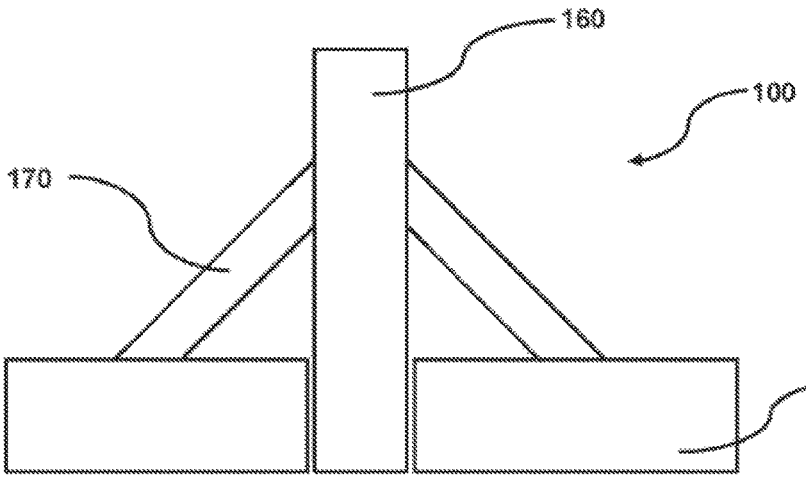
FIGS. 1A, 1B, and 1C illustrate an external side view, an internal side view, and a front view, respectively, of a slide training apparatus, according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of" when preceding a list of elements, modify the entire list of elements and do not modify the individual elements of the list.

Figure 1B:
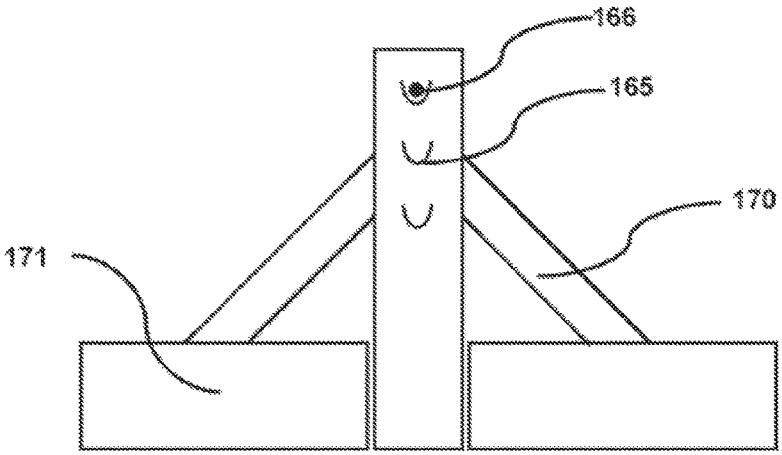
Figure 1C:
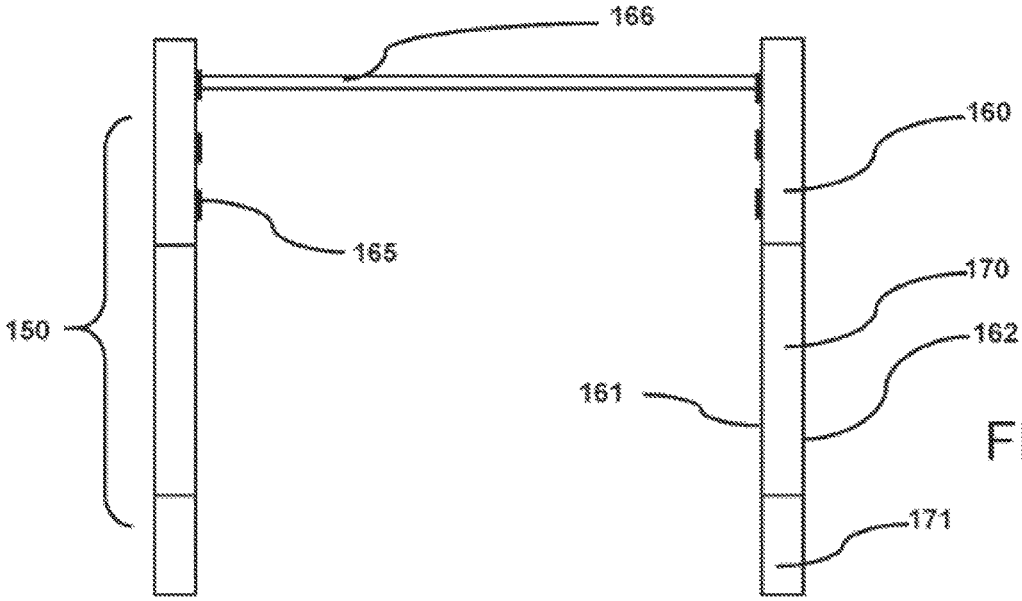
Figure 1D:
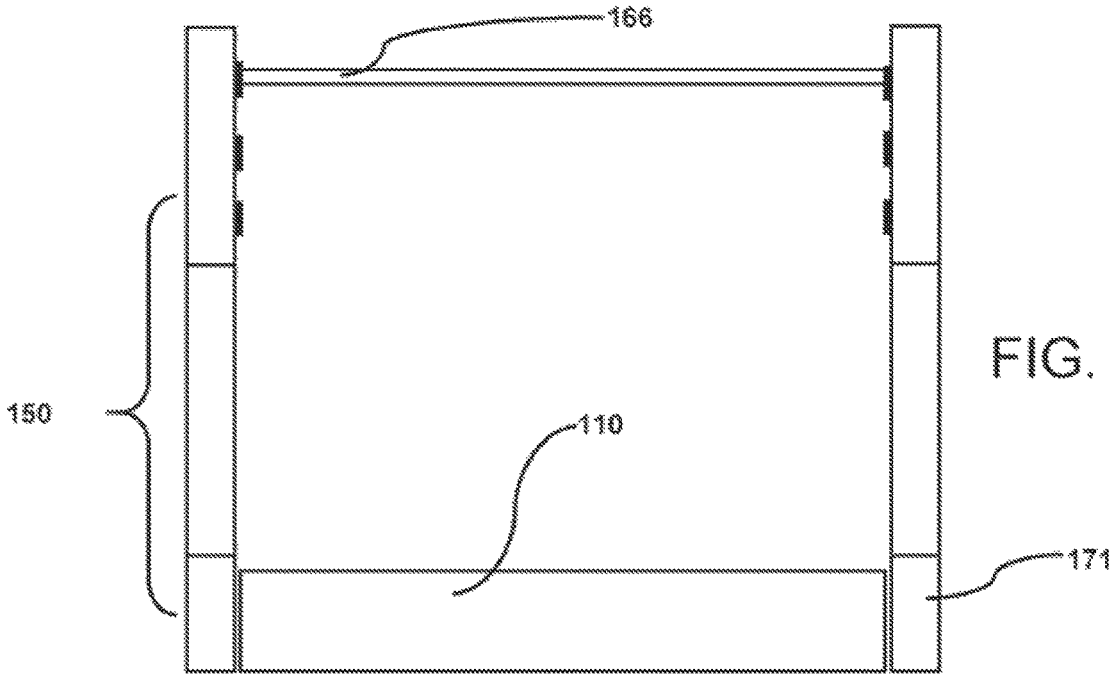
FIG. 1D illustrates a front view of a slide training apparatus including a mat, according to an example embodiment.

FIGS. 1A, 1B, and 1C illustrate an external side view, an internal side view, and a front view, respectively, of a slide training apparatus 100 according to an example embodiment. FIG. 1D illustrates a front view of the slide training apparatus including a mat, according to an example embodiment. According to this example embodiment, the apparatus, 100 comprises a side support structure 150, and may optionally include a cushioned mat 110, as shown in FIG. 1D, over which the slide support structure 150 is mounted. The mat 110 may be substantially rectangular and may include cut-out portions (not shown) therein to enable the slide support structure 150 to rest directly, or indirectly by means of feet or the like, on the ground. According to an example aspect, the mat may be four inches thick and 100 inches long. The mat 110 may be a single unit or may comprise a number of cushions which are stacked or disposed adjacent to one another. the mat may have a surface that permits a player to slide thereon or may permit sliding between two or more stacked cushions. Alternately, the slide support structure 150 may rest on the mat 110 itself. The slide support structure 150 comprises a pair of side beams 160, configured to rest on one of the ground and an upper surface of the mat and to extend substantially vertically therefrom. Each of the side beams 160 may be supported and held in an upright position by one or more support legs 170 and base supports 171. As shown in FIGS. 1A and 1B, each one or more of the support legs 170 may extend obliquely from a side beam 160 to one of the base supports 171. The base supports 171 may rest on the ground, as shown in FIGS. 1A, 1B, 1C, and 1D, or may rest on the mat 110. Alternately, the base supports 171 may be omitted, and each support leg 170 may extend from a side beam 160 to rest directly on the floor, ground, or mat 110. According to an example aspect, each support leg 170 may form a 45 degree angle with respect to its respective side beam 160, and may be approximately 50-51 inches long. However, these dimensions are merely examples. A cross bar 166 is adjustably mounted to the pair of side beams 160. According to one example aspect, as shown in FIGS. 1B and 1C, a plurality of brackets 165 may be mounted to the internal side 161 of each of the side beams 160. As shown, the brackets 165 may each comprise a curved support on which an end of the cross bar 166 may rest. Multiple pairs of brackets 165 may be provided at different heights along the side beams 160 in order to enable the cross bar 166 to be adjustable among a plurality of heights including, but not limited to 42 inches, 36 inches, and 30 inches. A total height of each of the side beams 160 may be, but is not limited to, 48 inches. A width, from an interior side 161 to an exterior side 162 of each of the side beams 160 may be, but is not limited to 4 inches. However, these dimensions are merely examples. The beams 160, support legs 170, and base supports 171 may be composed of any of a variety of different materials including, but not limited to, steel, carbon fiber, titanium, and plastic. According to one example aspect, at least the beams 160, support legs 170, and base supports 171 may be composed of a heavy-duty plastic such that the entire apparatus is lighter than if made from steel, and would be more appropriate for use by younger players. Each of the side beams 160, the legs 170, and the cross bar 166 may be collapsible for ease of storage and portability. Wheels, not shown, may be attached to the lower ends of the side beams 160, permitting the entire slide support structure 150 to roll. According to this embodiment, a player would approach the apparatus 100 from an end thereof, as shown in FIG. 1C.

Figure 2:
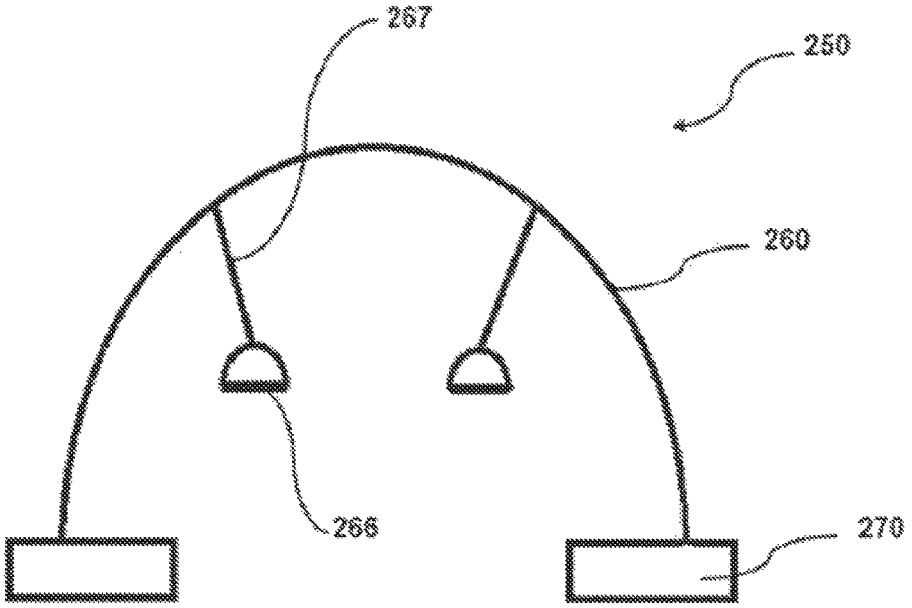
FIG. 2 is a front view of a slide support structure, according to another example embodiment.

FIG. 2 is a front view of a slide support structure 250 according to another example embodiment. As with the example embodiment of FIGS. 1A-IC, the slide support structure 250 may rest on the ground or on a mat, not shown in FIG. 2. The slide support structure 250 comprises an arch 260. As shown in FIG. 2, the arch 260 may be supported on feet 270, or the arch 260 may be self-supporting. According to an example aspect, the feet 270 may have a width of four inches and a height of 2 inches, and the apex of the arch 260 may be 48 inches above a surface on which the feet rest. However, these dimensions are merely examples. Handles 266 are attached to the arch 260 and hang below the arch 260 by means of attachments 267 which may be, for example rope, cord, wire, or another element. Alternately, the handles 266 may be connected directly to the arch 260. The arch 260 itself may be configured to elastically deform upon application of pressure from a player, to accommodate additional movement and to dampen sudden forces. The attachments 267 may comprise flexible or rigid materials. Wheels, not shown, may be attached to the lower ends of the arch 260 or to the feet 270, permitting the entire slide support structure 250 to roll. According to an example aspect, as viewed from the side, the arch 260 may have the form of a tunnel, extending in a direction into and out of the page with respect to FIG. 2. According to such an example aspect, the attachments 267 and handles 266 would attach to a track extending along a ceiling of the tunnel. The attachments 267 may be formed of a flexible material, such that, as a player executes a slide, the handles will support the player and move along with the player within the tunnel. According to another example aspect, the feet 270 may extend in a direction into and out of the page with respect to FIG. 2, and may include grooves along which the arch 260 may run, such that the arch can move with the layer during a slide. In any of the described aspects and embodiments, the attachments 267 and/or the handles 266 may be easily removable, and the arch 260 may be removable from the feet 270, so that the entire apparatus may be may be collapsible for ease of storage and portability. According to this embodiment, a player would approach the apparatus 200 from an end thereof, as shown in FIG. 2, and may grasp the handles 266 upon approach. One or both of the handles 266 and the attachments 267 may be adjustable to accommodate players of different sizes.

Figure 3A:
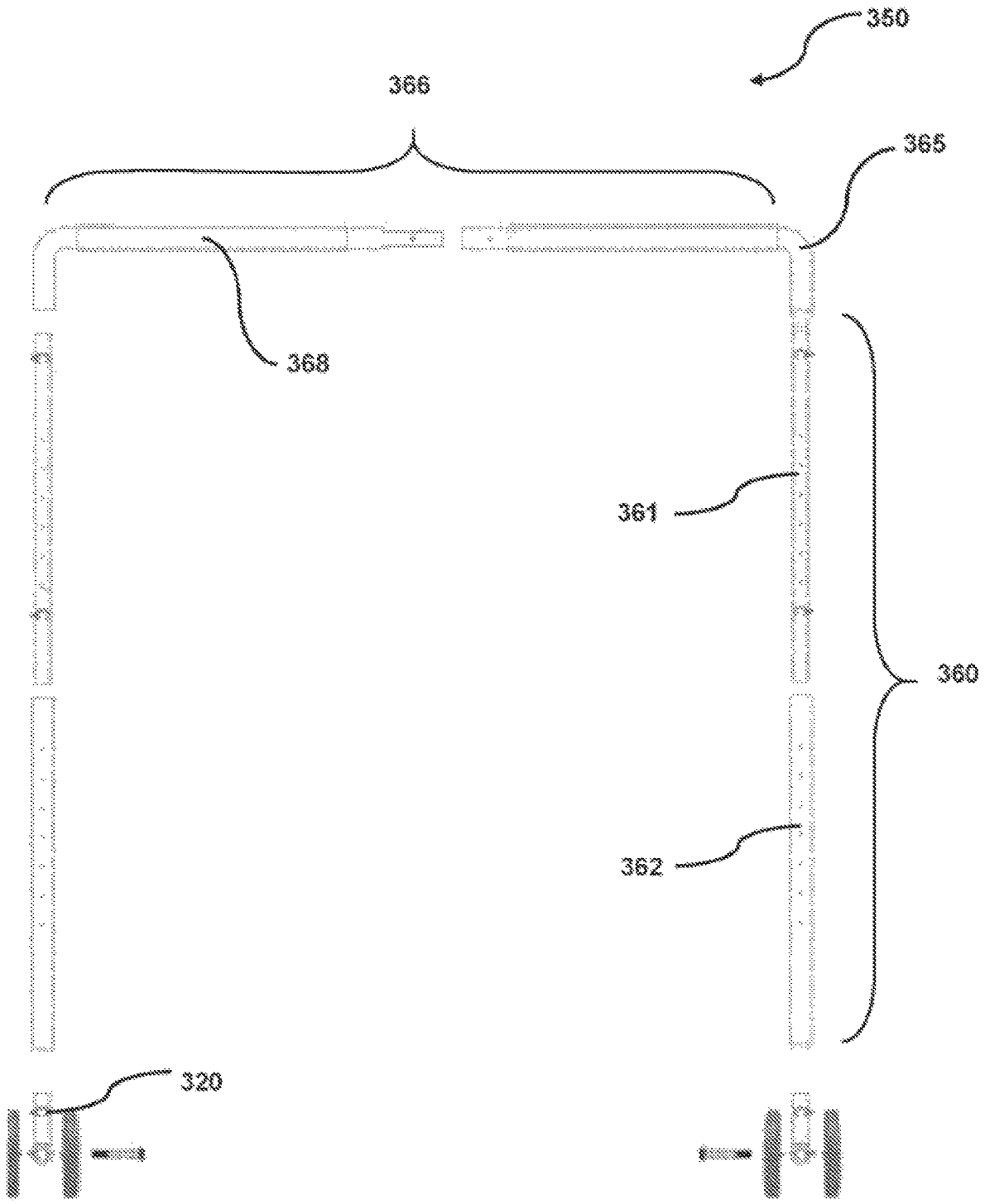
FIGS. 3A and 3B illustrate an exploded view, and a perspective view, respectively, of a slide support structure, according to another example embodiment.
Figure 3B:
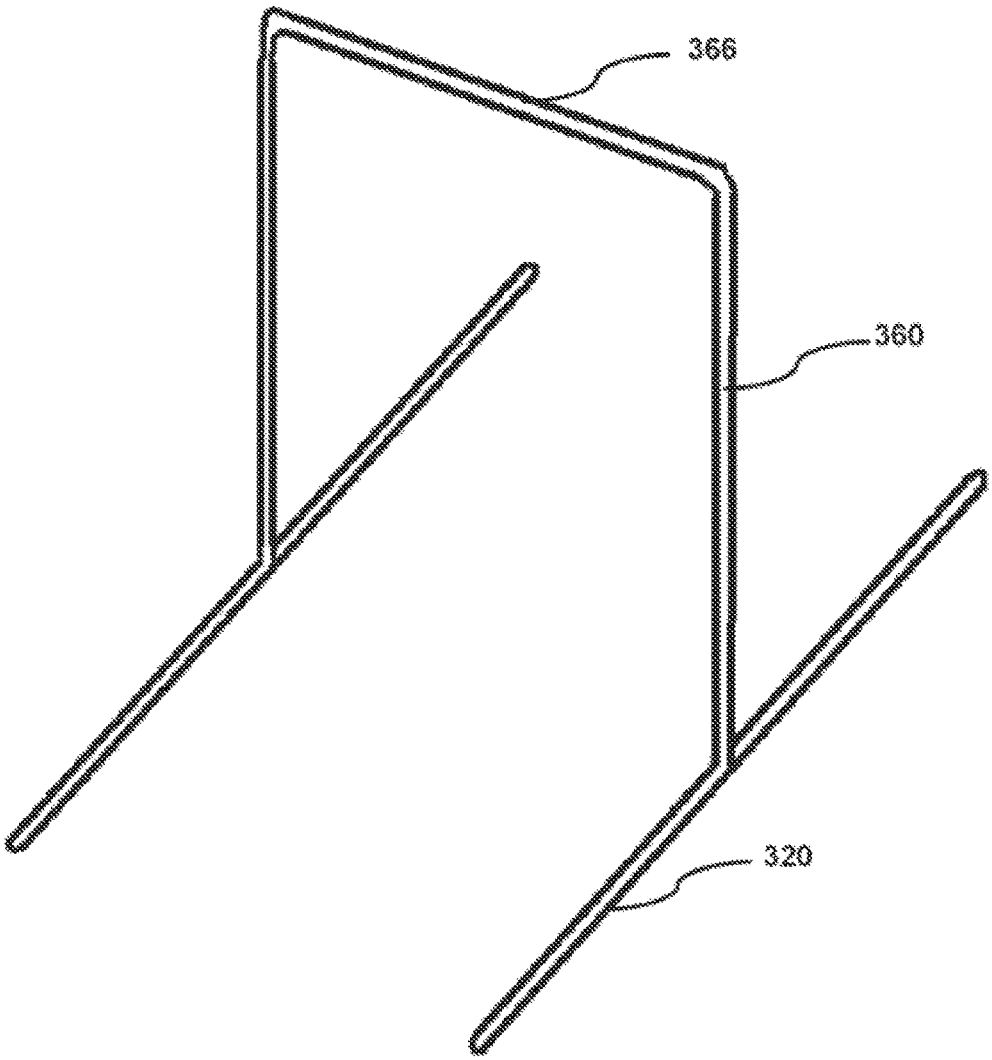

FIGS. 3A and 3B illustrate an exploded view, and a perspective view, respectively, of a slide support structure 350 according to another example embodiment. As discussed with respect to the previously-described example embodiments, the structure 350 may be mounted over an optional mat. The structure 350 comprises a pair of side posts 360, each configured to extend, in a substantially normal direction, upward from one of a pair of base supports 320. An attachment between each of the side posts 360 and a corresponding base support 320 may be such that the side post 360 is fixed, adjustable, and/or removable with respect to the corresponding base support 320. A cross bar 366 is mounted to upper ends of the pair of side posts 360. Each of the side posts 360, the base supports 320, and the cross bar 366 may comprise a single unit or two or more members attached to each other. For example, a side post 360 may comprise an upper side unit 361 and a lower side unit 362 which are attached to each other such that at least one end one of the units 361 and 362 is sized to fit within at least one end of the other of the units 361 and 362, such that the two units 361 and 362 are adjustable telescopically. One of the units 361 and 362 may include a series of holes therein and the other of the units 361 and 361 may include one or more spring-loaded pins therein, such that by positioning a pin to extend from one of the units 361 and 362, through a hole in the other of the units 361 and 362, the units may be adjustably held together. Alternately, both of the units 361 and 362 may include one or more holes therein, and the structure 350 may additionally include a separate pin which can be inserted through at least one hole in each of the units 361 and 362, so that the units may be adjustable held together. These pin and hole structures enable the side posts 360 to have adjustable lengths, enabling a height of the cross bar 366 to be adjustable to accommodate players of different heights and skill levels. Each of the base supports 320 and the cross bar 366 may also comprise a plurality of units, analogous to units 361 and 362 as discussed with respect to the side posts 360. The side posts 360 may be separable from and attachable to the respective base supports 320, for example, by means of analogous pin and hole structures. The structure 350 may further include a plurality of wheels, one wheel attached to each end of each of the pair of base supports 320. The wheels may be swivelable, such as casters, or may be fixedly mounted to enable the structure 350 to move in a direction along the ground substantially perpendicular to the extension of the cross bar 366. In addition to one or more units, the cross bar 366 may also comprise a corner joint 365 disposed at each end thereof, to attach the cross bar 366 to the side posts 360. The corner joints 365 may be attachable to the units of the cross bar 366 and to the respective side posts 360 via a pin and hole structure as discussed above, or by another means. One or more sleeves 368 is disposed around the one or more units of the cross bar 366, such that the sleeve 368 entirely or substantially entirely surrounds the circumference of the units of the cross bar 366. The sleeve 368 and the cross bar 366 are configured such that there is little friction therebetween, enabling the sleeve 368 to be freely rotatable around the cross bar. For example, the sleeve 368, or an interior circumference thereof, may be felt. The structure 350 may comprise two sleeves 368, each mounted around one of two units of the cross bar 366, each for one of a player's hands. According to any of the aspects and embodiments described herein, the cross bar may be a single piece or may be multiple pieces attached together. Likewise, the other elements may each be a single piece or may be multiple pieces attached together.

In use, a player may approach the structure 350 from an end thereof and grasp the at least one sleeve 368, while allowing their feet to slide under the cross bar 366, as the cross bar 366 supports at least some of the player's weight. In use, the structure 350 may have locked wheels or be without wheels, while a player moves underneath. Alternately, the structure 350 may include wheels which are not locked, enabling the structure 350 to slide along with the player. As discussed with respect to example embodiments described above, a mat may be positioned under the structure 350. Alternately, the structure may be plated on grass, dirt, sand, turf, or other practice surface. A player may being training with the structure 350 without wheels, or with locked wheels, to prevent movement, and may advance to using the structure 350 with unlocked wheels. The wheels may include a suspension mechanism.

Figure 4:
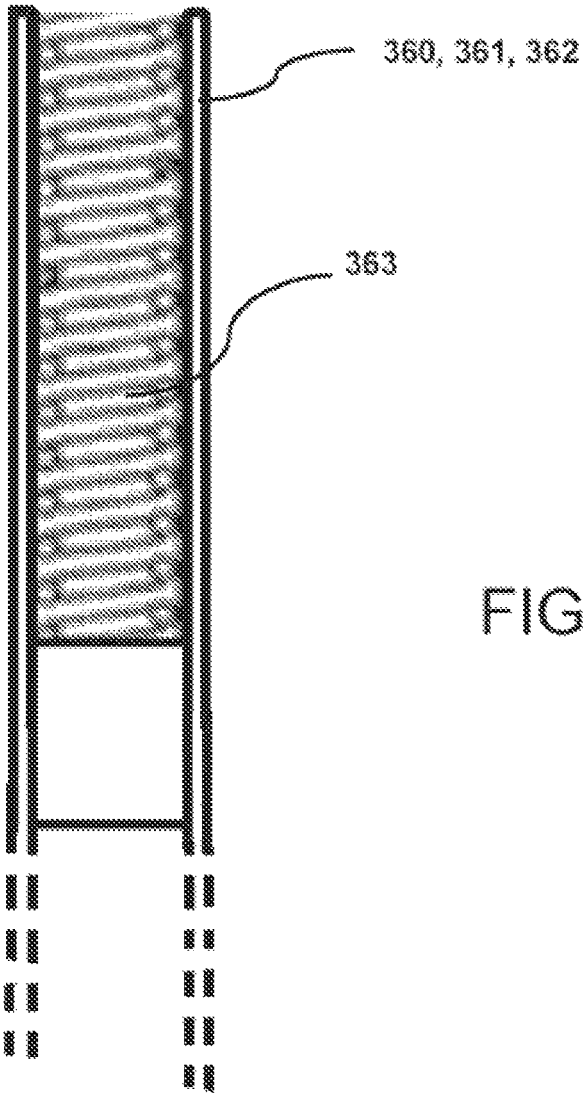
FIG. 4 is a cross-sectional view of a spring mechanism according to an example aspect.

According to an example aspect, the side posts 360 may further comprise spring mechanisms enabling the posts 360 to compress as weight is placed on the cross bar 366. FIG. 4 is a cross-sectional view of a spring mechanism according to an example aspect. This example spring mechanism comprises a spring 363 disposed within one of the units 361 and 362 of the side post 360. The spring 363 is configured to compress upon application of pressure, enabling the side post 360 to compress.

Figure 5A:
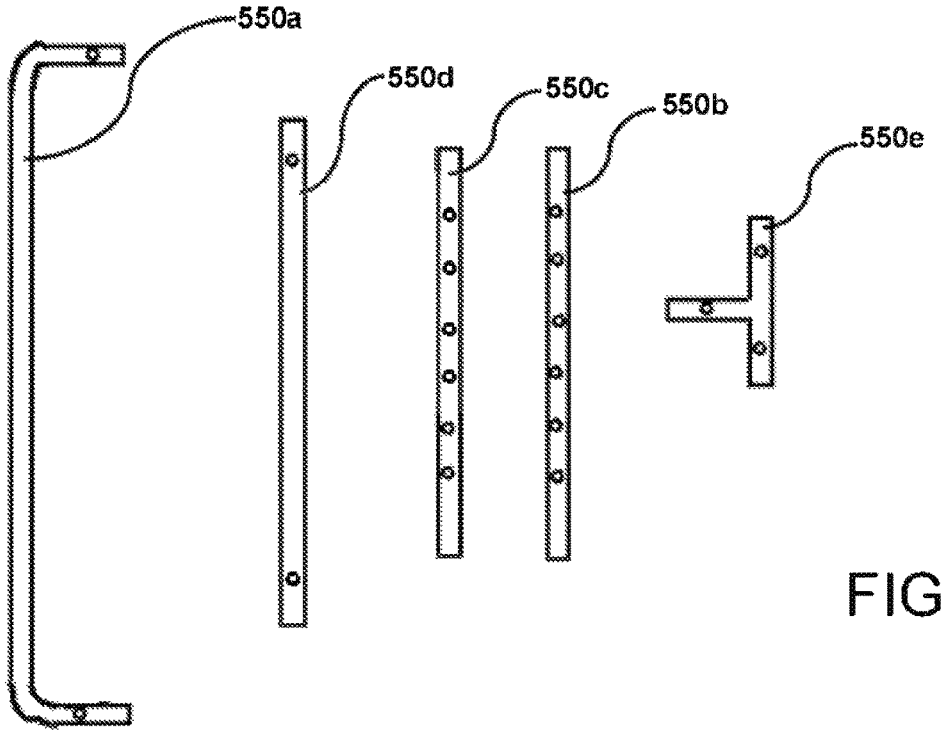
FIGS. 5A and 5B illustrate separate elements of a quick-connect structure, and positions of assembly of the quick-connect structure, according to another example embodiment.

FIG. 5A illustrates separate elements of a quick-connect structure 550 according to another example embodiment. According to this example embodiment, the structure 550 may be analogous to the structure 350 described with respect to FIGS. 3A and 3B, and may be comprised of a plurality of frame members 550-550-*e*. The quick-connect structure may be relatively light weight and easy to assemble and disassemble, as compared with the other example embodiments. The structure 550 may include four base elements 550*d*, two base connect elements 550*e*, two lower side elements 550*c*, two upper side elements 550*b*, and a single cross element 550*a*. Element 550*a* may have a length of 35.25 inches, corners with a radius of curvature of four inches, a height of 8.62 inches, and a circumference of 1.25 inches; elements 550*b* may have a length of 20 inches, a circumference of 1 inch, a spacing between each end and a hole of 2 inches, and a spacing between adjacent holes of 2 inches; elements 550*c* may have a length of 20 inches, a circumference of 1.25 inches, a spacing between each end and an adjacent hole of 2 inches, and a spacing between adjacent holes of 2 inches; elements 550*d* may have a length of 24 inches, a circumference of 1.25 inches, and a spacing, between each end and an adjacent hole of 1.99 inches; elements 550*e* may have a length of 11.97 inches, a circumference of 1 inch, a height of 4.49 inches, and a spacing between each end and an adjacent hole of 2 inches; and the diameter of each of the holes in each of the elements 550*b*-550*e* may be 0.13 inches. However, these dimensions are merely examples.

Figure 5B:
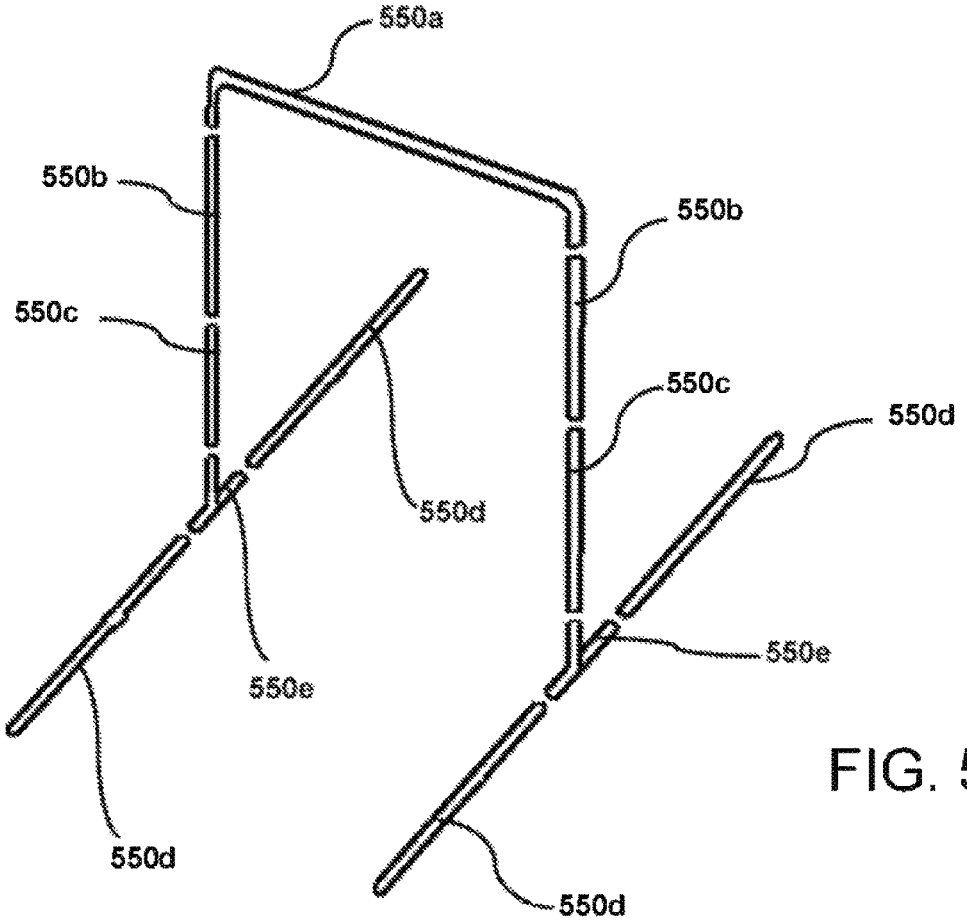

The individual elements 550*a*-550*e* may be assembled as shown in FIG. 5B. One or more connection ends of each of the elements 550*a*-550*e* may have holes therein, and the structure 550 may include a plurality of quick-lock pins to insert through the holes to hold the elements together when assembled. Each quick-lock pin may include a head portion and a shaft portion, with the head portion including a button in operable connection to a latch on the shaft portion, such that, once inserted into the appropriate holes in the elements, the pin cannot be removed without pressing the button.

The quick-connect features of the elements of the example embodiment of FIGS. 5A and 5B may be applied to elements of the other example embodiments, as would be understood by those of skill in the art.

Alternately, the elements may be friction fitted together, with each connection comprising a narrow end of one element fitting snugly, but removably within a wider end of an adjacent element.

According to an example aspect, any one or more of the example embodiments of FIGS. 1A-1C, 2, 3A, 3B, 5A, and 5B may further include a transportation container, such as a tote bag or other container, configured to hold all of the units/elements of the structure when disassembled.

For example, the embodiment of FIGS. 5A and 5B may further include a 40 inch×9 inch tube tote, which may include a handle and zipper or other closing mechanism.

According to an example aspect, a slide training structure according to one more of the example embodiments described above may further include a spring-loaded support (not shown) that may be attached to the player to cushion their fall and supply an overhead support for their arms as the spring-loaded support contacts the ground or mat. The spring-loaded support may comprise a harness made of nylon webbing or the like, and including a waist belt, leg loops, belay loop, and buckles to support a player's body. The harness may be attached to the cross-bar or other overhead element by a flexible material, such that a player wearing the harness would touch the ground softly and be supported. An attachment of the harness to the cross-bar may be elastic.

A slide training apparatus according to one or more of the example embodiments described above may provide an overhead grip that a player can approach and use to support themselves as they get into an appropriate sliding position and execute a slide. Over time, and with training, a player may work toward approaching the apparatus and sliding while only lightly gripping the apparatus, with an ultimate goal of not gripping the apparatus at all.

Matters of these example embodiments that are obvious to those of ordinary skill in the technical field to which these example embodiments pertain may not be described here in detail.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. A slide training apparatus comprising:

a slide support structure comprising:

a first foot and a second foot;

an arch comprising a first end supported on the first foot and a second end supported on the second foot, wherein the arch is configured to elastically deform when the player grasps the handles and slides under the slide support structure; and a first handle and a second handle attached to the arch, wherein each of the first handle and the second handle is configured to be grasped by a player when the player slides under the slide support structure.

2. The slide training apparatus according to claim 1, further comprising a mat positioned at least partially between the first foot and the second foot and at least partially underneath the arch, the mat having a surface configured to permit a player to slide on the mat.

3. The slide training apparatus according to claim 1, the slide support structure further comprising:

a first extension element attached between the first handle and the arch; and a second extension element attached between the second handle and the arch.

4. The slide training apparatus according to claim 1, wherein each of the first handle and the second handle hangs below the arch.

* * * * *